US005341203A

United States Patent [19]

Tokutsu

[11] Patent Number: 5,341,203

[45] Date of Patent: Aug. 23, 1994

[54] IMAGE FORMING APPARATUS WITH AN AUTOMATIC DOCUMENT FEEDING APPARATUS DURING INTERRUPT MODE OF OPERATION

[75] Inventor: Akihito Tokutsu, Yokohama, Japan

[73] Assignee: Kabushiki Kaisha Toshiba, Kawasaki, Japan

[21] Appl. No.: 34,571

[22] Filed: Mar. 19, 1993

[30] Foreign Application Priority Data

Aug. 25, 1992 [JP] Japan ..... 4-225964

[51] Int. Cl.[5] ..... G03G 21/00

[52] U.S. Cl. ..... 355/313; 271/3; 271/256; 271/314; 355/321

[58] Field of Search ..... 355/308, 309, 313, 314, 355/50, 75, 321; 271/3, 3.1, 4, 6, 7, 9, 256, 258, 265, 301, 902

[56] References Cited

U.S. PATENT DOCUMENTS

| | | | |
|---|---|---|---|
| 4,281,919 | 8/1981 | Nomura et al. | 355/309 |
| 4,523,752 | 6/1985 | Kigawa et al. | 355/314 X |
| 4,705,393 | 11/1987 | Ito | 355/314 |
| 4,708,461 | 11/1987 | Okuda et al. | 355/314 |
| 4,723,148 | 2/1988 | Hamakawa | 355/314 |
| 4,736,937 | 4/1988 | Okuda et al. | 355/314 |
| 4,786,041 | 11/1988 | Acquaviva et al. | 271/3.1 |
| 4,903,085 | 2/1990 | Ikeda et al. | 355/320 |

FOREIGN PATENT DOCUMENTS 0333140 9/1989 European Pat. Off. .

OTHER PUBLICATIONS

European Search Report.

*Primary Examiner*—A. T. Grimley
*Assistant Examiner*—William J. Royer
*Attorney, Agent, or Firm*—Limbach & Limbach

[57] ABSTRACT

An image forming apparatus with an automatic document feeding apparatus which is mounted on a platen glass or document table of an electronic copying apparatus having an interruption copy mode function. A document transportation belt of the automatic document feeding apparatus is stretched facing the platen glass. When an interruption key is depressed, the document transportation belt and transportation rollers of a document discharge device are driven so that an uncopied document on the platen glass is moved to be temporarily evacuated from an exposure region. The evacuated document is held between the transportation rollers and pinch rollers. In this state, the automatic document feeding apparatus is opened, and an interruption document is manually set on the platen glass. Subsequently, after closing the document feeding apparatus, interruption copying operation is performed. After the interruption copying operation is finished, the interruption document is removed, and the document feeding apparatus is closed. Then, the interruption copy mode is canceled by depressing the interruption key again. When the interruption copy mode is canceled, the transportation rollers and the document transportation belt rotate reversely, thereby automatically restoring the temporarily evacuated document to an exposure position on the platen glass.

5 Claims, 10 Drawing Sheets

IMAGE FORMING APPARATUS WITH AN AUTOMATIC DOCUMENT FEEDING APPARATUS DURING INTERRUPT MODE OF OPERATION

BACKGROUND OF THE INVENTION

1. Field of the Invention

The present invention relates to an automatic document feeding apparatus, which is attached to an image forming apparatus, such as an electronic copying apparatus, having an interruption copy mode function, and automatically feeds documents onto a document table.

2. Description of the Related Art

Modern versions of practical image forming apparatuses are provided with an automatic document feeding apparatus (ADF), in which a plurality of documents collectively held on a document feeder tray are picked up and fed one after another to a document table, and are discharged from the document table after undergoing exposure scanning.

Conventionally, the ADF, which is attached to one such image forming apparatus having an interruption copy mode function, is arranged so that a document in an exposure region on the document table is automatically discharged to a document receiving section when an interruption copy mode is selected during operation.

In restarting the interrupted copying operation by using the ADF after the interruption copying is finished, the document discharged to the document receiving section is returned to the document feeder tray to be resupplied for copying.

Thus, according to the conventional ADF, the document on the document table is automatically discharged to the document receiving section when the interruption copy mode is selected during the use of the ADF. In resuming the interrupted operation by means of the ADF after the end of the interruption copying, the discharged document must be manually returned to the document feeder tray.

In a type such that the documents set on the document feeder tray are successively taken out from the bottom side, in particular, the document recovered from the document receiving section should be inserted into the bottom portion of the tray so that the copying sequence is maintained. In order to restore the recovered document securely, therefore, the set documents must be removed from the feeder tray to allow the recovered document to be slid properly under the stack, and then reset in place.

Thus, restoring the recovered document is so troublesome that it is a long time before the copying operation is allowed to be restarted, and moreover, the manual resetting is liable to cause errors in delivery.

SUMMARY OF THE INVENTION

The present invention has been contrived in order to solve these problems of the prior art, and therefore, its object is to provide an automatic document feeding apparatus, in which a document on a document table can be temporarily evacuated from an exposure region without being discharged to a document receiving section when an interruption copy mode is selected during the use of the feeding apparatus, and the evacuated document can be automatically returned to the document table when the interruption copy mode is canceled, so that the operativity and working efficiency of the apparatus can be improved.

According to the present invention, there is provided an image forming apparatus with an automatic document feeding apparatus having an interruption copy mode comprising: a document table for supporting a document sheet; means for holding a plurality of document sheets; first transport means, not facing the document table while covering the document table, for transporting the document sheets from the holding means to the document table; second transport means, facing the document table while covering the document table, for transporting the document sheets transported by the first transport means to a predetermined position on the document table; third transport means, not facing the document table while covering the document table, for transporting the document sheets forwardly transported by the second transport means from the document table; means for receiving the document sheets transported by the third transport means; and means for controlling the second and third transport means when the image forming apparatus is set in an interruption copy mode, such that the second transport means transports a document sheet on the document table to the third transport means, and the third transport means stops transporting the document sheet and holds at least a part of the document sheet.

According to the automatic document feeding apparatus of the present invention, the document on the document table can be temporarily evacuated from the exposure region, where the document detecting means is activated, without being discharged to the document receiving section when the interruption copy mode is selected, and the evacuated document can be restored in place when the interruption copy mode is canceled. Thus, the operativity and working efficiency of the apparatus can be improved.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

One embodiment of the present invention will now be described with reference to the drawings of FIGS. 1 to 14.

Figure 1:
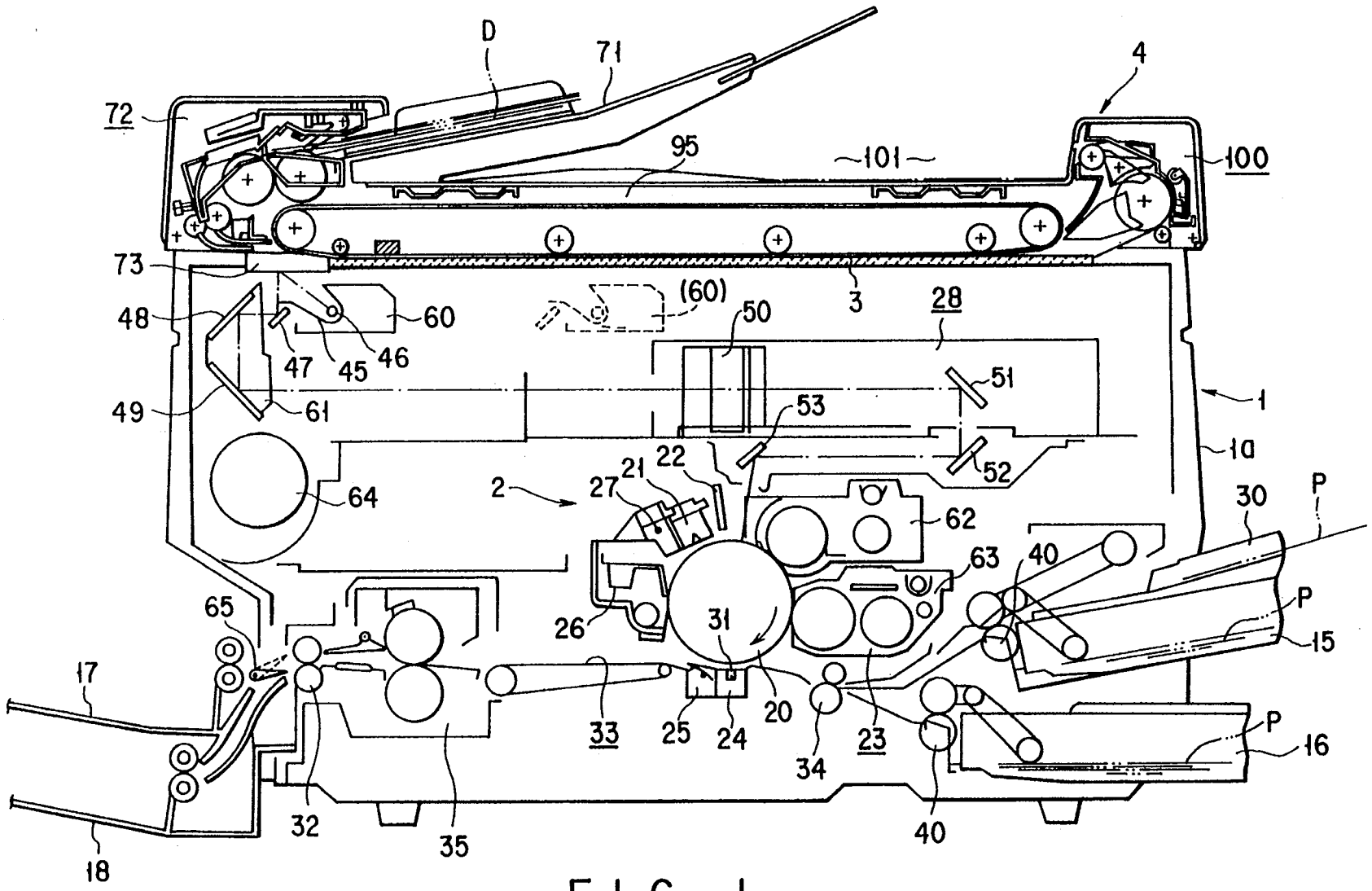
FIG. 1 is a schematic view of an electronic copying apparatus furnished with an automatic document feeding apparatus (ADF) according to one embodiment of the present invention.

FIG. 1 shows an image forming apparatus furnished with an automatic document feeding apparatus according to the present invention.

An electronic copying apparatus (plain paper copier or PPC) 1, for use as the image forming apparatus, has an interruption copy mode function. A housing 1*a* of the PPC 1 contains image forming means 2 which is used to form images by image forming processes including charging, exposure, developing, transfer, cleaning, fixing, etc.

Provided on the top surface of the apparatus housing 1*a* is the automatic document feeding apparatus (ADF) 4 for automatically feeding documents D onto a platen glass 3 for use as a document table.

Figure 2:
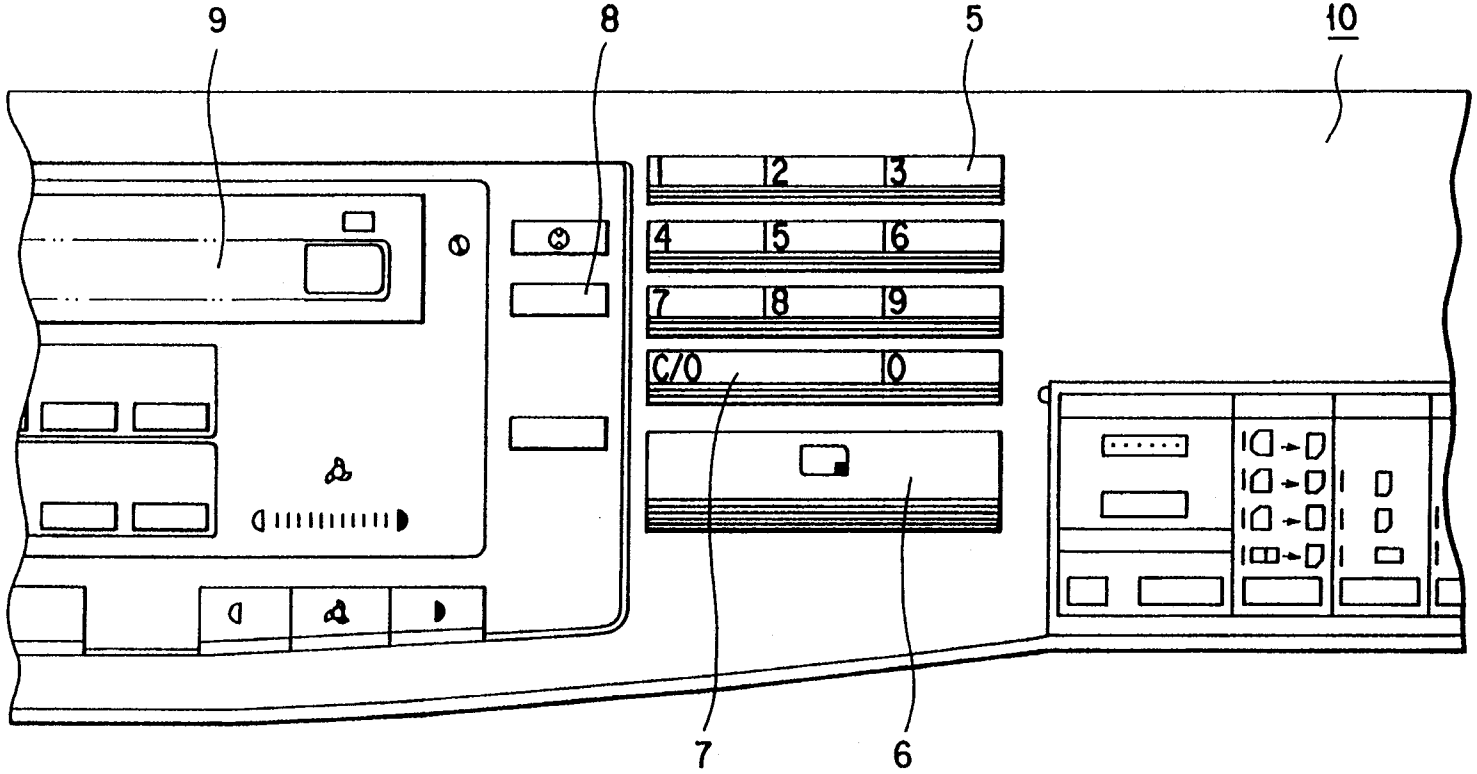
FIG. 2 is a partial plan view illustrating a control panel of the electronic copying apparatus shown in FIG. 1.

Further, the apparatus housing 1 carries, on the front edge portion of its top surface, a control panel 10 as input/display means which is provided with ten-keys 5, print key 6, clear/stop key 7, interruption key 8, display section 9 for displaying various pieces of information, and the like, as shown in FIG. 2.

First and second paper cassettes 15 and 16, which are stored with paper sheets P to be supplied to the image forming means 2, are attached to the right-hand side of the apparatus housing 1*a*. First and second receiving trays 17 and 18, which receive copies or fixed paper sheets P, are attached to the left-hand side of the housing 1*a*.

The image forming means 2 is constructed in the following manner.

A drum-shaped photoreceptor 20, for use as an image carrying body, is disposed substantially in the central portion of the apparatus housing 1*a*. The photoreceptor 20 is surrounded by a main charger 21, erasing device 22, developing device 23, transfer device 24, separating device 25, cleaner 26, de-electrifier 27, etc., which are successively arranged in the rotating direction (indicated by the arrow in FIG. 1) of the photoreceptor 20. Disposed in the upper portion of the housing 1*a*, moreover, is an exposure device 28 which scans each document D set on the platen glass 3, and exposes the surface of the photoreceptor 20 to light through the space between the erasing device 22 and the developing device 23.

Formed in the apparatus housing 1*a*, furthermore, is a paper transportation path 33 along which the paper sheets p, either automatically fed from the paper cassette 15 or 16 or manually supplied through a sheet-bypass guide 30, which doubles as a cover for the upper cassette 15, are guided to an exit roller pair 32 on the left-hand side of the housing 1*a* via an image transfer section 31 between the photoreceptor 20 and the transfer device 24.

An aligning roller pair 34 and a fixing device 35 are located on the upper- and lower-course sides, respectively, of the paper transportation path 33 with respect to the image transfer section 31.

A paper supply unit 40, used to pick up the paper sheets p one after another and deliver them to the paper transportation path 33, is disposed in the vicinity of each of the respective attachment portions of the paper cassettes 15 and 16.

The exposure device 28 includes an exposure lamp 46 which, backed by a reflector 45, is used to illuminate the document D set on the platen glass 3 on the top surface of the apparatus housing 1*a*. A reflected light beam from the document surface is guided successively through first, second, and third mirrors 47, 48 and 49 to a lens 50. Then, the light beam transmitted through the lens 50 is guided successively through fourth, fifth, and sixth mirrors 51, 52 and 53 to the photoreceptor 20.

The exposure lamp 46, backed by the reflector 45, and the first mirror 47 are mounted on a first carriage 60 which can reciprocate along the lower surface of the platen glass 3. The second and third mirrors 48 and 49 are mounted on a second carriage 61 which moves at half the speed of the first carriage 60 in the same direction therewith. As these carriages 60 and 61 move from left to right in the state of FIG. 1, the document D set on the platen glass 3 is scanned, and the photoreceptor 20 is slit-exposed to an image corresponding to the document D.

Further, the lens 50, which is mounted on a third carriage (not shown), moves to a predetermined position for scaling-up or -down copying operation.

The developing device 23 is composed of an upper developing unit 62 for color developing and a lower unit for black developing. Thus, developing can be effected alternatively using black or other color, e.g., red. The first carriage 60 carries thereon a spotting unit (not shown) for assigning that region of the document D which is not expected to be reproduced as the document is copied. The erasing device 22 can erase an electric charge corresponding to the region assigned by means of the spotting unit. A cooling fan 64 is located over the fixing device 35 in the apparatus housing 1*a*.

Disposed beside the exit roller pair 32, moreover, is a gate 65 which serves alternatively to distribute the paper sheets P, delivered from the roller pair 32, to the first and second receiving trays 17 and 18.

Figure 3:
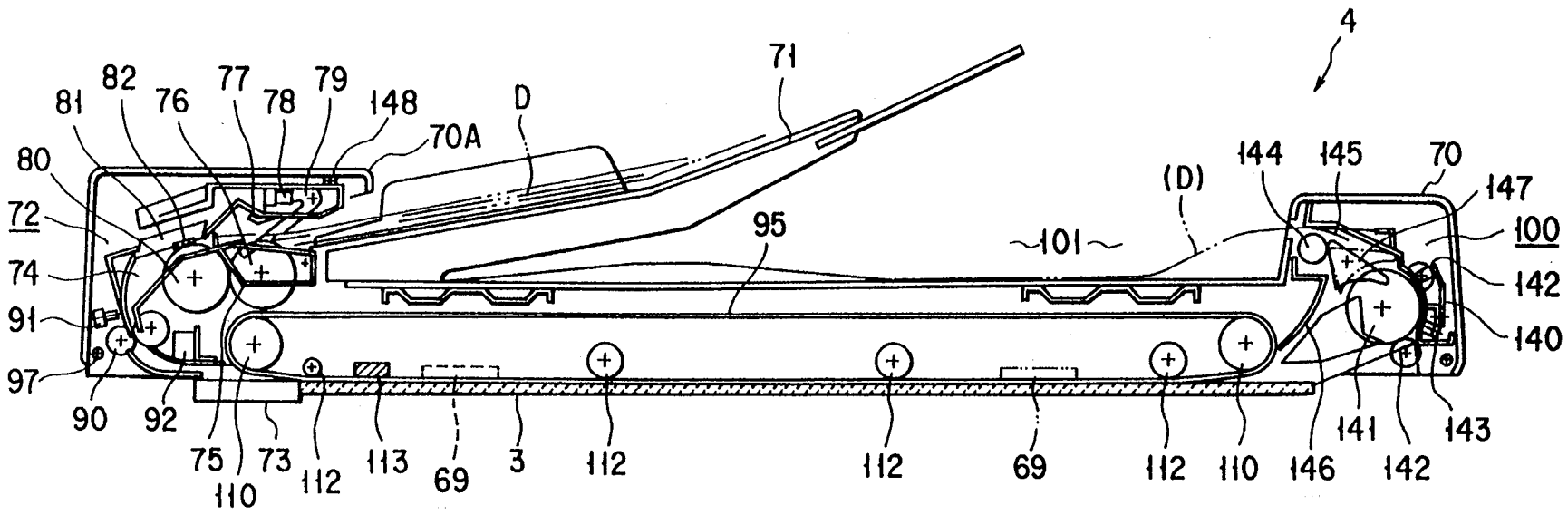
FIG. 3 is a schematic view of the ADF according to the one embodiment of the invention.
Figure 4:
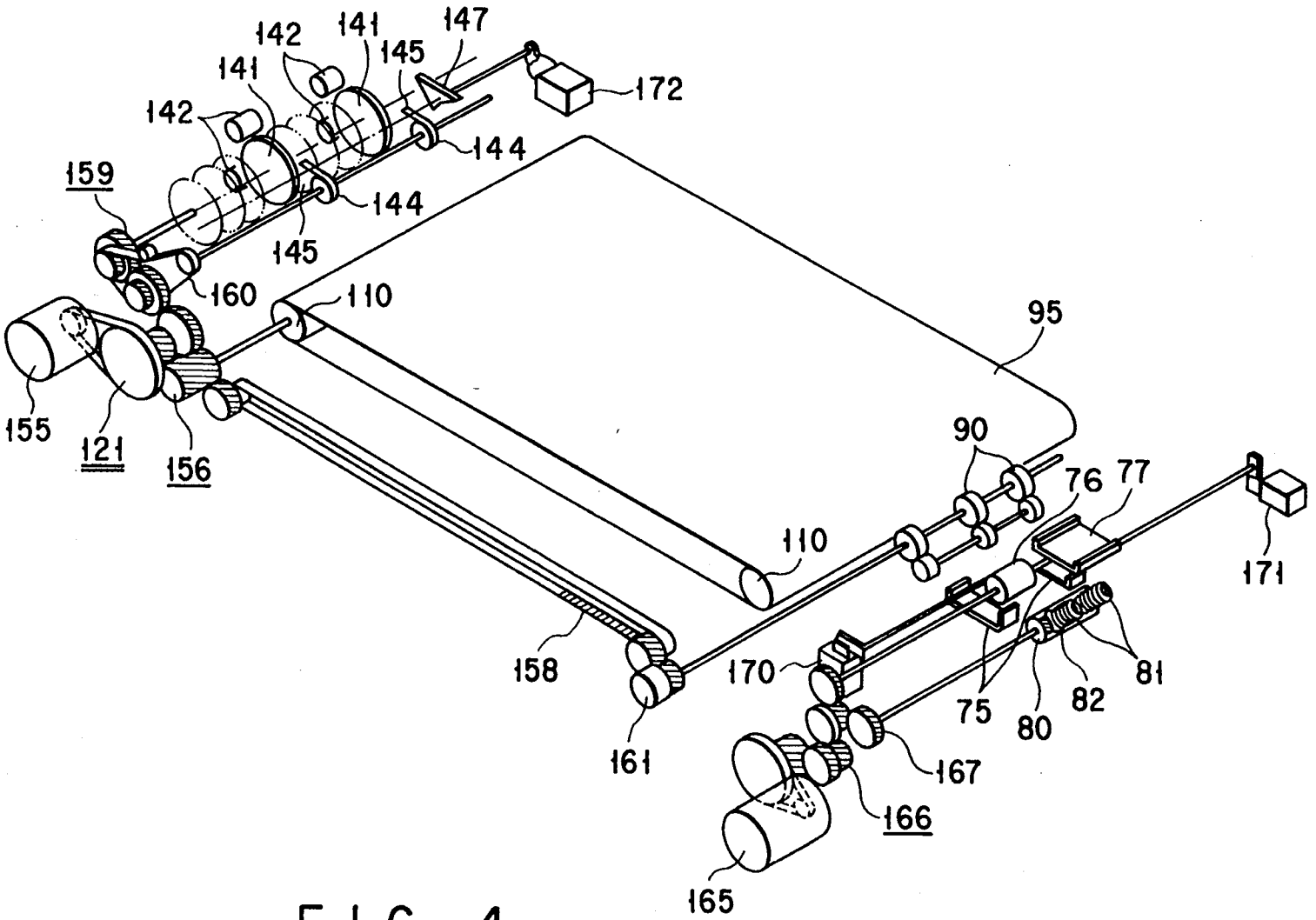
FIG. 4 is an exploded perspective view of a drive system of the ADF as taken from the rear side.

Referring now to FIGS. 3 and 4, the construction of the ADF 4 will be described.

The ADF 4 is a unit in which various members described in the following are incorporated in a cover housing 70 as a unit casing.

The rear edge portion of the cover housing 70 is swingably mounted on the rear edge portion of the top surface of the image forming apparatus housing 1*a* by means of a plurality of hinge devices 69 (see FIG. 3). If necessary, moreover, the ADF 4 may be arranged so that its whole structure can be rocked around the hinge devices to expose the area over the platen glass 3.

As shown in FIG. 3, a document feeder tray 71, for use as document holding means capable of collectively holding a plurality of documents D, is located on a left-of-center portion of the top surface of the cover housing 70.

Delivery means 72 (first transport means) is provided in the vicinity of the document feeder tray 71. The delivery means 72 picks up the documents D, which are held on the tray 71 with their image forming surface downward, one after another from bottom to top, and feeds them to one end side (left-hand end side of FIG. 3) of the platen glass 3.

The delivery means 72 is constructed in the following manner.

A U-shaped document supply path 74 adjoins the lower end of the declining document feeder tray 71. The document supply path 74 connects the lower end portion of the tray 71 and the top portion of a document stopper 73, which extends along the left-hand end edge of the platen glass 3. The path 74 guides each document D delivered from the delivery means 72 in a manner such that the document D is turned inside out to have its document information recording surface downward.

Shutters 75 for truing up the respective end edges of the documents D on the document feeder tray 71 are located on the upper-course side of the document supply path 74. Arranged in the vicinity of the shutters 75 are a pickup roller 76 for picking up the documents D, a weight plate 77 for pressing the documents D against the roller 76, and an actuator 79 of an empty sensor 78.

A loosening roller 80 and a loosening pad 82, which is pressed very softly against the roller 80 by means of the urging force of springs 81, are arranged ahead of the pickup roller 76 with respect to the document delivery direction. With this arrangement, the documents can be securely fed one after another.

Disposed on the lower-course side of the document supply path 74, on the other hand, is an aligning roller pair 90 for correcting the skew of each document D and timing the document supply. An alignment sensor 91 for detecting the document D to time the operation of the roller pair 90 is located in front of the roller pair 90. A size sensor 92 for detecting the document size is disposed behind the roller pair 90.

A document transportation belt 95 for use as document transportation means (second transport means) is stretched so as to cover the upper surface of the platen glass 3. As the belt 95 travels, the document D fed by means of the delivery means 72 is carried onto the platen glass 3. The document D on the glass 3 is transported from the one end side (left-hand end side of FIG. 3) of the glass 3 to the other end side (right-hand end side), and is then delivered to a document discharge device 100 for use as document discharge means (third transport means), which is provided inside the right-hand side portion of the cover housing 70.

The document D delivered to the document discharge device 100 is discharged to a document receiving section 101 which is formed on the upper surface of the cover housing 70.

The document transportation belt 95 is formed of a wide endless belt which, having a white outer surface, is passed between and around a pair of belt rollers 110. The belt 95 can be run in either direction, forward or reverse, by means of a belt drive mechanism 121, which will be mentioned later.

Arranged on the reverse side of the inner stroke portion of the document transportation belt 95 are a plurality of belt backup rollers 112, used to bring the lower surface of the belt 95 closely into contact with the upper surface of the platen glass 3, and a set switch 113 for sensing the set state of each document D.

The document discharge device 100 is constructed in the following manner.

The device 100 is provided with a U-shaped document discharge path 140, which connects the right-hand end edge of the platen glass 3 and the document receiving section 101. In this arrangement, the document D is turned inside out so that its document information recording surface faces upward as it is discharged.

Arranged at the middle-course portion of the document discharge path 140 are transportation rollers (reversal rollers) 141, pinch rollers 142 for pressing the document D against the rollers 141, and a sensor 143 for use as document detecting means for detecting the trailing end of the document D bound for the exit.

Arranged on the lower-course side of the document discharge path 140 are exit rollers 144 and leaf springs 145 for pressing the document D against their corresponding rollers 144.

A flapper 147 for use as distributing means is situated this side of the location of the exit rollers 144. The flapper 147 serves to guide the document D, reversed by means of the transportation rollers 141, straight along the document discharge path 140 to the document receiving section 101, or to guide the document D to a document return path 146 in order to feed it again onto the platen glass 3 after the document D is reversed so that its other side is copied.

As shown in FIG. 3, the delivery means 72 is enclosed by a cover 70A which is swingable around a shaft 97. The cover 70A can be lifted to expose the delivery means 72 in case of document jamming in the document supply path 74. The state of the cover 70A, open or closed, is detected by means of a cover switch 148 so that the document D cannot be introduced into the apparatus unless the cover 70A is put on.

Referring now to the perspective view of FIG. 4 taken from the rear side, a drive system of the ADF 4 will be described.

The document transportation belt 95 is driven in either direction, forward or reverse, by means of the belt drive mechanism 121. More specifically, the arrangement is such that the driving force of a first motor 155, for use as a drive source, is transmitted to one of the belt rollers 110 through a first power transmission mechanism 156, which is composed of a pulley, belt, gears, etc. The first motor 155 is a pulse motor whose rotation is controlled by means of driving pulses.

The driving force of the first power transmission mechanism 156 is transmitted to the aligning roller pair 90 through a second power transmission mechanism 158, which is composed of a belt, pulleys, etc., and is also transmitted to the transportation rollers (reversal rollers) 141 through a third power transmission mechanism 159, which is composed of a group of gears.

The rotation of the aligning roller pair 90, which is driven by means of the first motor 155, is controlled by means of an electromagnetic clutch 161 which is incorporated in the second power transmission mechanism 158.

Figure 5:
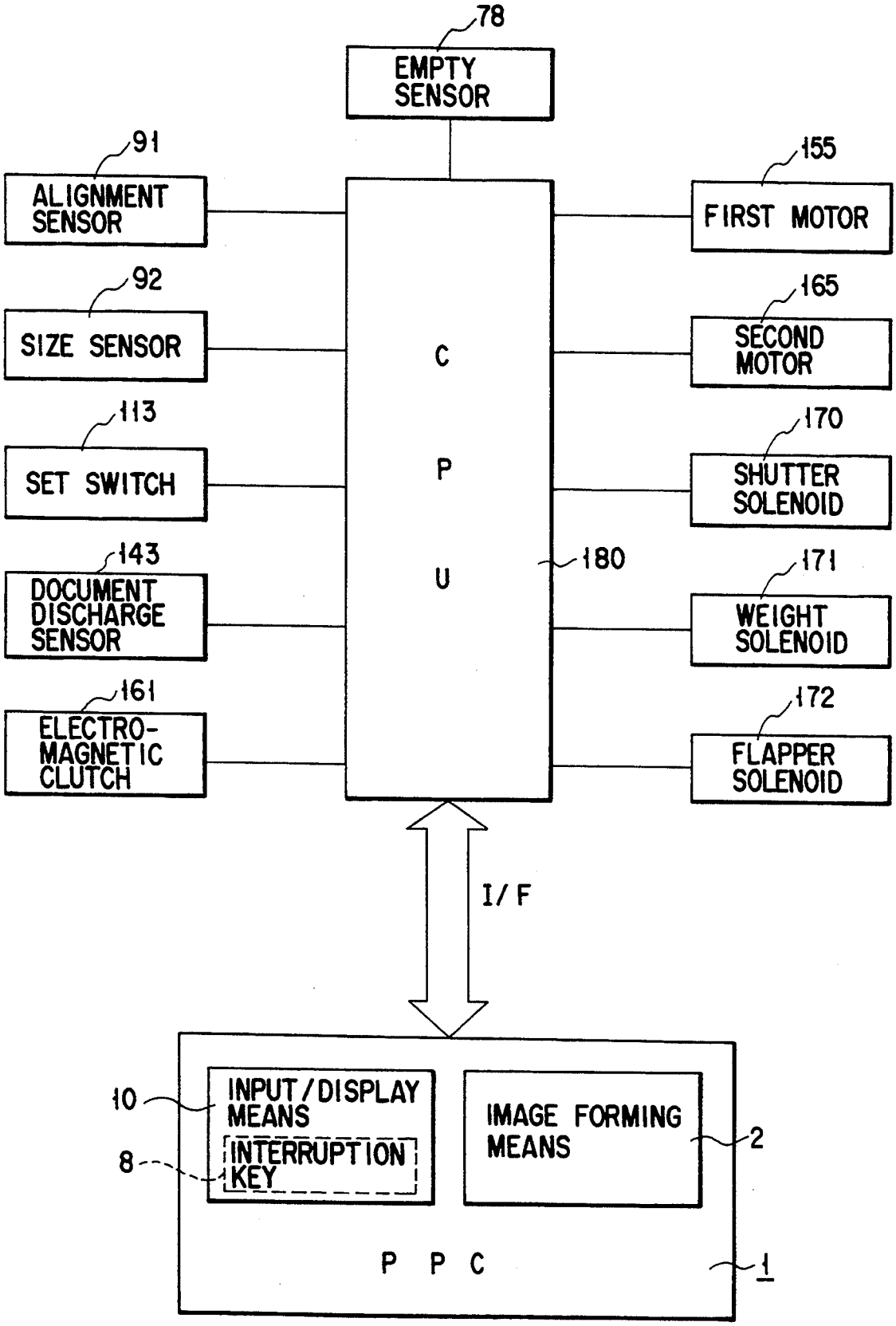
FIG. 5 is a block diagram illustrating a control system of the ADF.

The driving force of the third power transmission mechanism 159 is transmitted to the exit rollers 144 through a fourth power transmission mechanism 160, which is composed of a belt, pulleys, etc. Further, the driving force of a second motor (document supply motor) 165 is transmitted to the pickup roller 76 through a fifth power transmission mechanism 166, which is composed of pulleys, belt, gears, etc. The driving force of the mechanism 166 is further transmitted to the loosening roller 80 by means of a gear 167. The shutters 75 are driven by means of a shutter solenoid 170. Also, the weight plate 77 and the flapper 147 are driven by means of a weight solenoid 171 and a flapper solenoid 172, respectively. FIG. 5 is a block diagram illustrating a control system of the ADF 4. A CPU 180 for use as control means is connected to the PPC 1 through an interface circuit I/F. Thus, the CPU 180 controls the operation of the ADF 4 associated with the image forming operation of the image forming means 2 of the PPC 1. When an interruption copy mode is selected by means of the interruption key 8, which is provided on the control panel 10 as the input/display means, moreover, the ADF 4 is controlled so as to perform document processing operation, which will be mentioned later.

Further, the CPU 180 is connected with the empty sensor 78, alignment sensor 91, size sensor 92, and set switch 113, as well as with the first motor 155 as the drive source for the aligning roller pair 90, document transportation belt 95, transportation rollers 141, and exit rollers 144, the electromagnetic clutch 161 for the intermittent drive of the aligning roller pair 90, and the second motor 165 as the drive source for the pickup roller 76 and loosening roller 80.

Furthermore, the CPU 180 is connected with the shutter solenoid 170, weight solenoid 171, and flapper solenoid 172.

The following is a description of the operation for a single-sided document threading mode of the ADF 4 constructed in this manner.

First, a plurality of documents D are collectively set on the document feeder tray 71 shown in FIGS. 1 and 3. Meanwhile, necessary information is inputted through the control panel 10 (see FIG. 2) for use as the input/display means, and the print key 6 is depressed thereafter.

Thereupon, the pickup roller 76 and the loosening roller 80 rotate, so that the first or lowest document D on the document feeder tray 71 is picked up and supplied. This document D is fed through the aligning roller pair 90 to the bottom side of the document transportation belt 95 which is traveling in the feeding direction.

when the whole document D is delivered onto the platen glass 3 as the document table, the document transportation belt 95 travels reversely for a distance corresponding to a given number of pulses, in response to a signal from the set switch 113. As a result, the document D is transported in the reverse direction so that its left-hand end abuts against the document stopper 73 to be positioned thereby. Thus, setting the document D is completed.

When the document setting is finished, the document D is scanned by means of the exposure device 28 (see FIG. 1) of the image forming means 2, and copying operation for the paper sheets P, based on the conventional image forming processes using the image forming means 2, is started.

As the document transportation belt 95 travels after the copying operation is finished, the document D is taken away from the platen glass 3 and discharged to the document receiving section 101 by means of the document discharge device 100.

When the first document D is removed from the platen glass 3, another document D is fed onto the glass 3. This operation is repeated until the document feeder tray 71 is cleared of the documents D.

Referring now to FIGS. 6 to 14, there will be described the operation of the ADF 4 for the case where the interruption copy mode is selected.

Referring first to FIGS. 6, 7, 8 and 12, a flow of operation from the selection of the interruption copy mode to the hold of the automatically-fed uncopied document D in a shunt position will be described.

Figure 12:
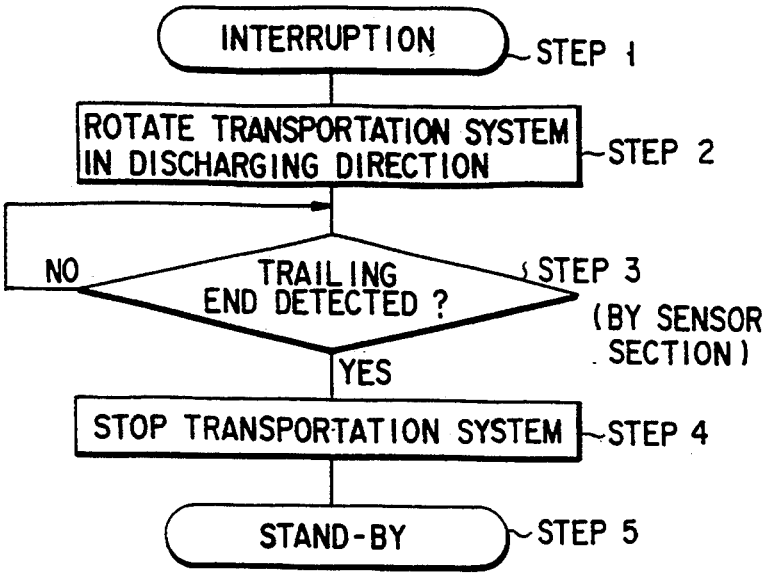
FIG. 12 is a flow chart showing a flow of operation from the selection of the interruption copy mode to the hold of an automatically-fed uncopied document in a shunt position.

When the interruption key 8 (see FIG. 2) on the control panel 10 is depressed to select the interruption copy mode (Step 1 of FIG. 12), the transportation system rotates in the discharging direction (Step 2 of FIG. 12). More specifically, the document transportation belt 95 stretched over the platen glass 3 travels, and the transportation rollers 141 of the document discharge device 100 rotate, as shown in FIG. 7.

Figure 6:
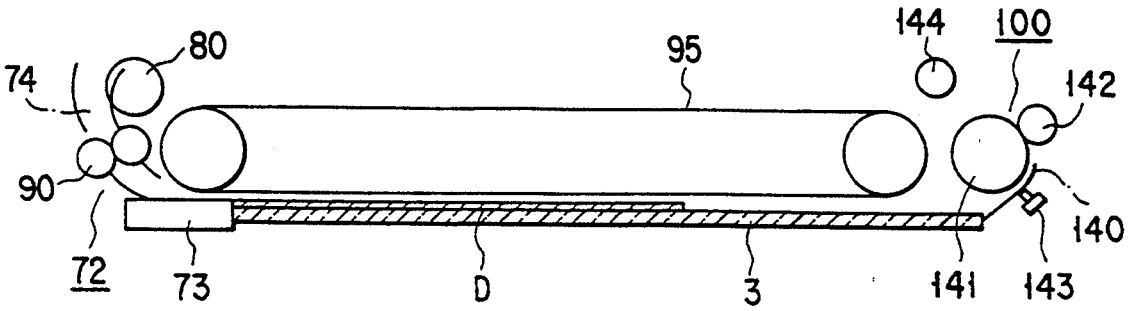
FIGS. 6 to 11 are diagrams individually illustrating different operating states of the ADF in an interruption copy mode.
Figure 7:
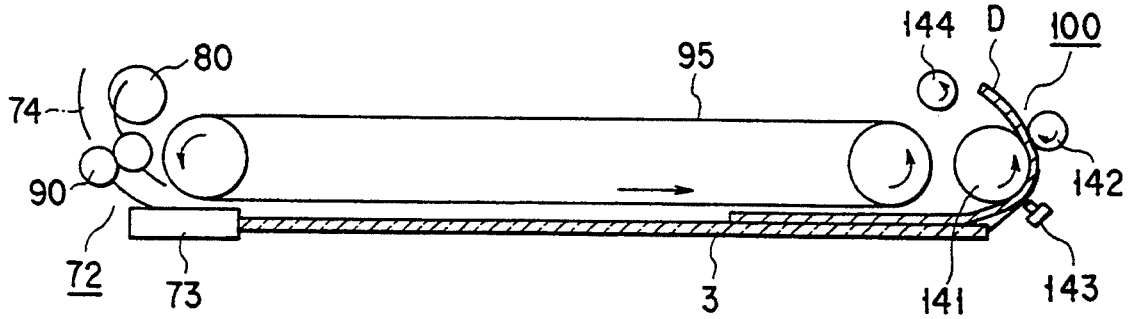
Figure 8:
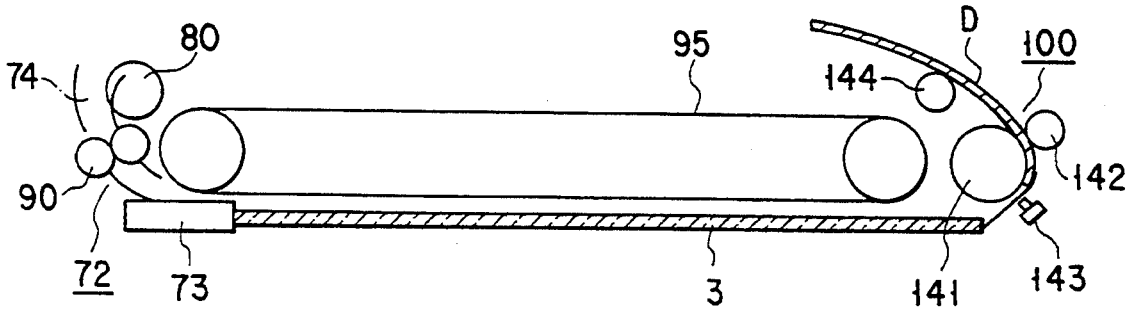

Thereupon, the uncopied document D, set on the platen glass 3 by the automatic document feed, as shown in FIG. 6, is transported in the discharging direction (or to the right as illustrated) as the document transportation belt 95 travels, as shown in FIG. 7. As the transportation rollers 141 of the document discharge device 100 rotate, moreover, the document D is transported toward the document receiving section 101.

When the trailing end of the document D is detected by means of the sensor 143 for use as the document detecting means (Step 3 of FIG. 12), the document transportation belt 95 as the transportation system and the transportation rollers 141 of the document discharge device 100 stop (Step 4 of FIG. 12), so that the document D ceases to be transported. At this time, the document D is held on standby in a manner such that it is caught between the transportation rollers 141 and the pinch rollers 142 (Step 5 of FIG. 12).

When the document D on the platen glass 3 is thus removed from an exposure region, the interruption copy is allowed.

Thereafter, the ADF 4 is swung open, and an interruption document Dw is set on the platen glass 3.

Referring now to FIGS. 9, 10, 11, 13 and 14, a flow of operation from the interruption copying for the interruption document Dw and the cancel of the interruption copy mode to the restart of the automatic document feeding operation will be described.

Figure 9:
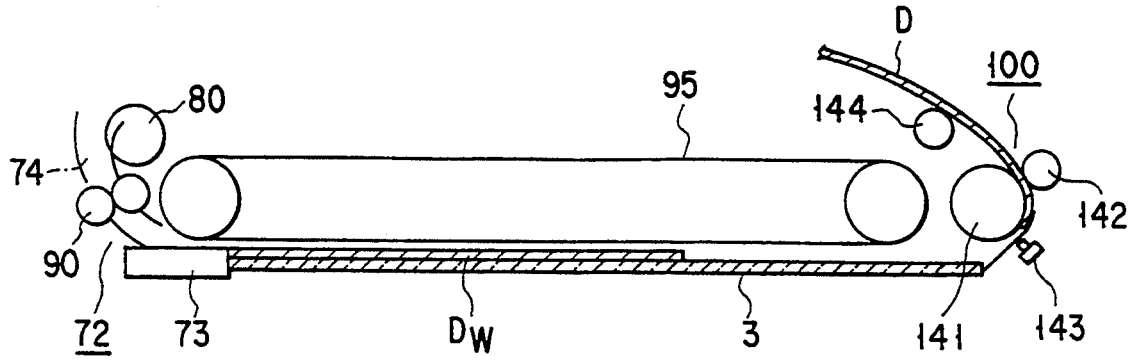
Figure 10:
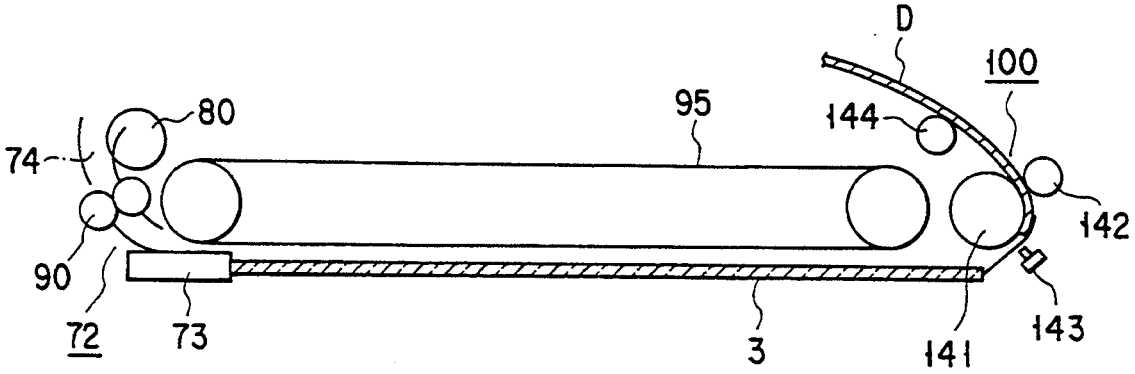
Figure 14:
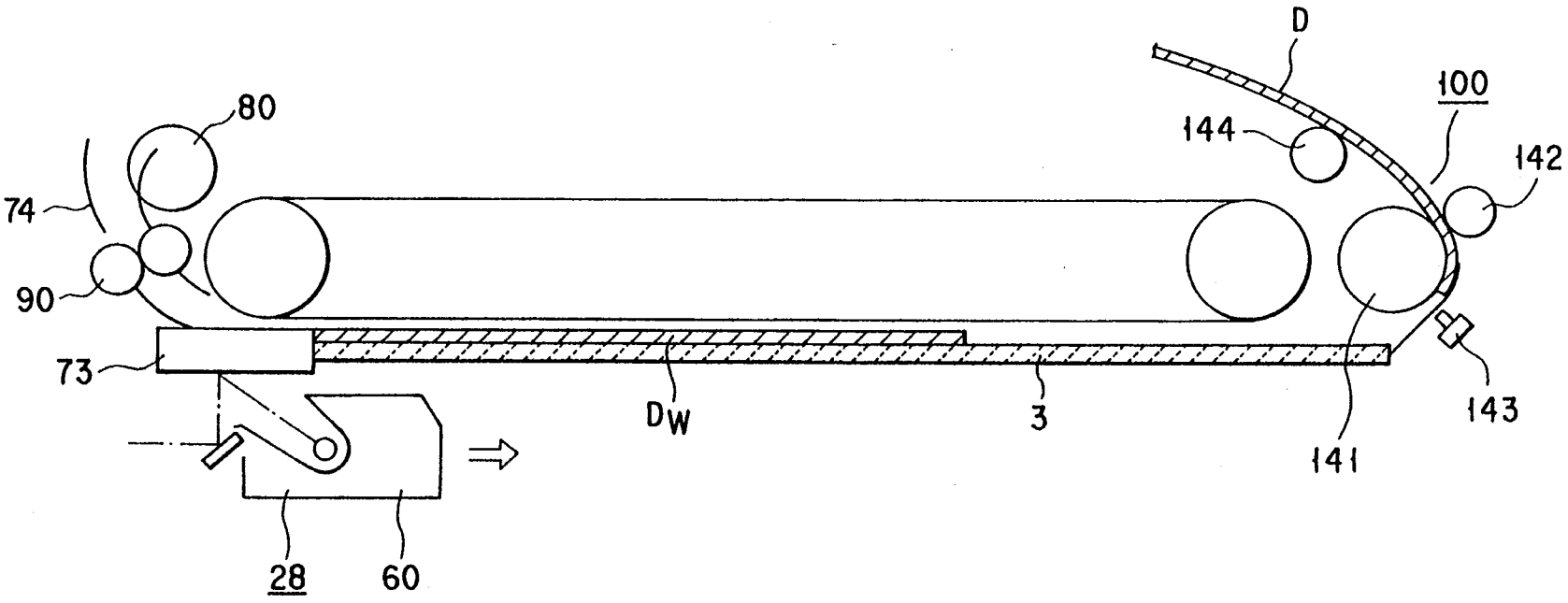
FIG. 14 is a diagram showing a document position for the interruption copy mode in the ADF according to the one embodiment of the invention.

First, after the interruption document Dw is set, the ADF 4 is closed so that the document Dw is pressed by means of the document transportation belt 95, as shown in FIG. 9. Then, the necessary information is inputted through the control panel 10, and the print key 6 is depressed. Thereupon, the interruption document Dw is exposed and scanned by means of the exposure device 28, as shown in FIG. 14, whereby the document Dw is copied.

When copying the interruption document Dw is finished in this manner, the ADF 4 is opened, and the interruption document Dw on the platen glass 3 is removed. Thereafter, the ADF 4 is closed again to establish the state shown in FIG. 10.

Figure 13:
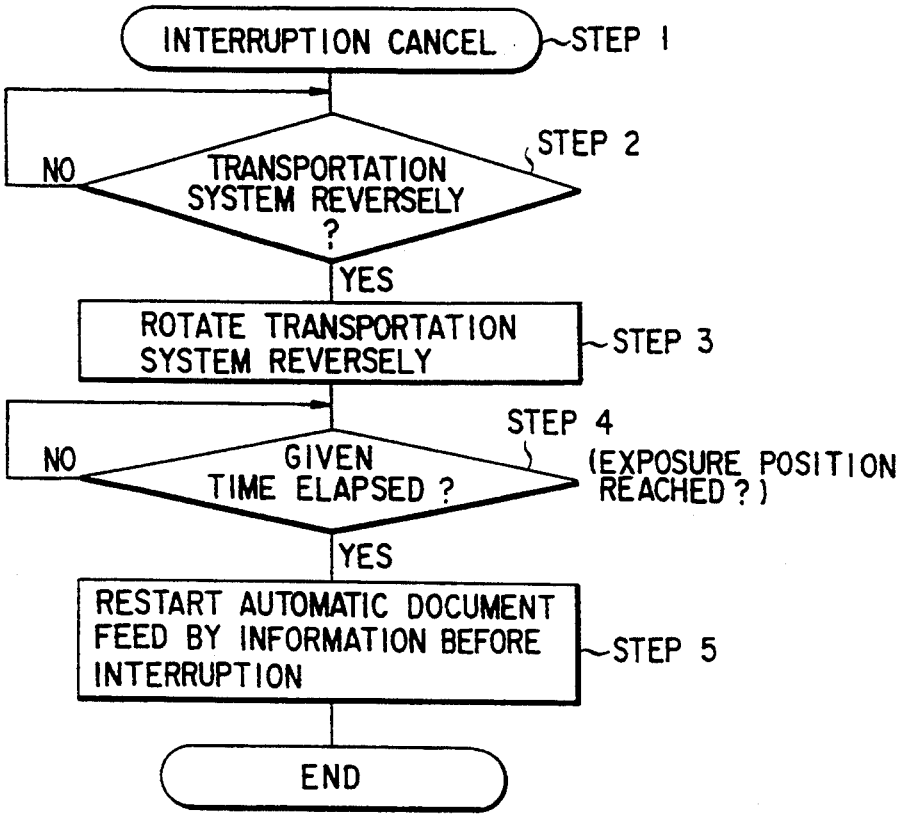
FIG. 13 is a flow chart showing a flow of operation from the cancel of the interruption copy mode to the restart of automatic document feeding operation.

Then, by depressing the interruption key 8 again, the interruption copy mode is canceled (Step 1 of FIG. 13). At this time, if it is detected by means of a switch (not shown) that the ADF 4 is closed so that the document transportation belt 95, for use as a transportation section, is closely in contact with the platen glass 3 (Step 2 of FIG. 13), the document transportation belt 95 as the transportation system and the transportation rollers 141 rotate in the reverse direction (Step 3 of FIG. 13).

Figure 11:
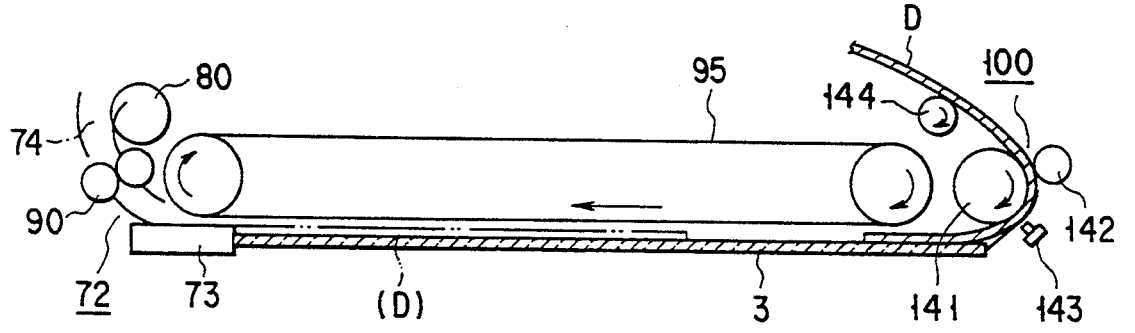

Thereupon, the uncopied document D, temporarily evacuated from the exposure region, as shown in FIG. 11, is fed in the reverse direction to be delivered to the document transportation belt 95 as the transportation rollers 141 rotate, and is further transported to the left of FIG. 11 as the belt 95 travels. When a given time has elapsed (Step 4 of FIG. 13), the document transportation belt 95 and the transportation rollers 141 stop. As a result, the document D is reset in a predetermined exposure position on the platen glass 3, that is, in a position where its end edge abuts against the document stopper 73, as indicated by two-dot chain line in FIG. 11.

When resetting the uncopied document D, temporarily evacuated from the exposure region by selecting the interruption copy mode, is completed in this manner, the copying operation for the reset document D and the automatic document feeding operation are restarted by the CPU 180, for use as the control means, on the basis of the information given before the interruption (Step 5 of FIG. 13). These operations are continued until the document feeder tray 71 is cleared of the documents D.

If an interruption is made when three copies of the same document D are taken, out of ten copies to be taken in total as assigned, for example, the information given before the interruption includes information for taking the ten copies of the same document D, information for the interrupted copy, etc. After the interruption is removed, copying operation is continued from the fourth copy, and is finished when the tenth is taken.

According to the ADF 4 of the present invention, as described above, the document D on the platen glass 3 is temporarily evacuated from the exposure region, where the sensor 143 as the document detecting means is activated, without being discharged to the document receiving section 101 when the interruption copy mode is selected. When the interruption copy mode is canceled, the evacuated document D can be restored in place. Thus, the operativity and working efficiency of the apparatus can be improved.

Since the automatic document feeding operation can be restarted on the basis of the information given before the interruption when the interruption copy mode is canceled, moreover, the operativity and working efficiency of the apparatus can be further improved.

According to the embodiment described above, the automatic document feeding apparatus is designed so that each document D is supplied through the one end side of the platen glass 3, for use as the document table, and is discharged through the other end side. However, the present invention is not limited to this arrangement, and the document D may be both supplied and discharged through the one end side of the platen glass 3, as shown in FIG. 15.

Figure 15:
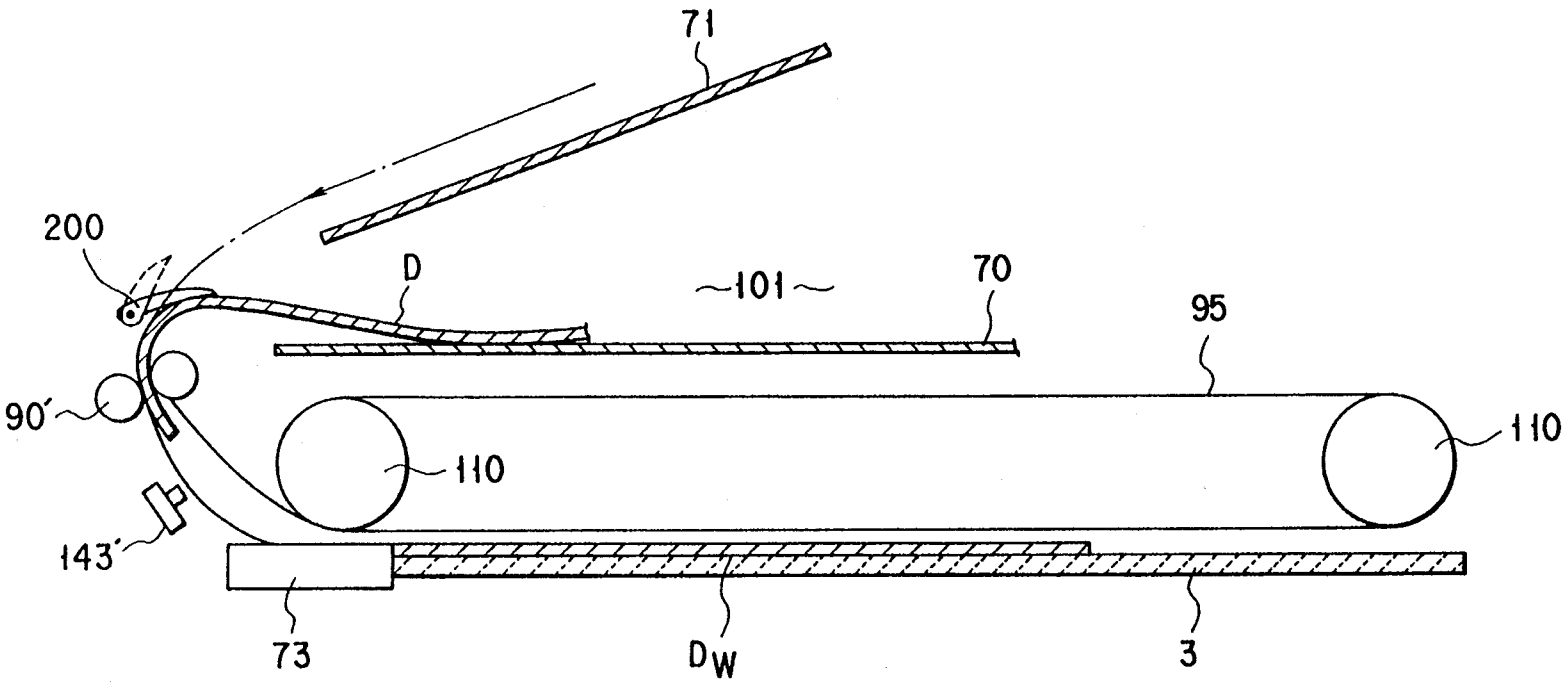
FIG. 15 is a schematic view of an ADF according to another embodiment of the invention.

According to the alternative embodiment shown in FIG. 15, a transportation roller pair 90' is provided as a transportation system for transporting those documents D which are delivered from the document feeder tray 71 and those documents D which are temporarily evacuated from the platen glass 3 in response to an interruption. Also, the apparatus of this embodiment is provided with a sensor 143', for use as document detecting means, and a flapper 200 as distributing means for guiding the evacuated document D toward the document receiving section 101. Like reference numerals are used to designate like portions throughout the drawings, and a detailed description of those portions will not be repeated.

According to the foregoing embodiments, moreover, the uncopied document D is evacuated to the position completely off the platen glass 3 when the interruption copy mode is selected. Naturally, however, part of the document D may be allowed to remain on the platen glass 3, provided it is situated outside the exposure region in which the interruption document Dw is set.

It is to be understood, furthermore, that the present invention is not limited to the embodiments described above, and that various changes and modifications may be effected therein by one skilled in the art without departing from the scope or spirit of the invention.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An image forming apparatus with an automatic document feeding apparatus, comprising:

a document table for supporting a document sheet;

means for holding a plurality of document sheets;

first transport means, not facing the document table while covering the document table, for transporting the document sheets from said holding means to the document table;

second transport means, facing the document table while covering the document table, for transporting the document sheets transported by said first transport means to a predetermined position on the document table;

third transport means not facing the document table while covering the document table, for transporting the document sheets transported by said second transport means from the document table;

means for receiving the document sheets transported by said third transport means;

means for detecting that said automatic document feeding apparatus covers said document table;

means for applying light to a document sheet transported to the predetermined position by said automatic document feeding apparatus, and for reading an image from the document sheet;

means for forming on an image carrier an image corresponding to the image read by said image-reading means;

condition setting means for setting image forming conditions in which to form an image by said image-forming means;

mode setting means for setting said image-forming means in an interruption copy mode so that said image-forming means stops forming an image in a first condition set by said condition setting means, and for causing said image-forming means to form an image in a second condition set by said condition setting means;

means for controlling said second and third transport means, when the image forming apparatus is set in the interruption copy mode by said mode setting means, such that said second transport means transports a document sheet on the document table to said third transport means, and said third transport means stops transporting the document sheet and holds at least a part of the document sheet, and for controlling said second and third transport means such that said second transport means transports the document sheet back toward said second transport means, and said second transport means transports the document sheet to said predetermined position on the document table, when said detecting means detects that said automatic document feeding apparatus covers said document table or when the interruption copy mode is cancelled after said image-forming means has formed an image in the second condition while set in the interruption copy mode.

2. An image forming apparatus with an automatic document feeding apparatus according to claim 1, wherein said first transport means is located at a first side of said document table, said third transport means is located at a second side of said document table, which is opposite to the first side thereof, and said control means controls said second and third transport means such that said first transport means transports the document sheet toward the second side of said document table when the image forming means is set in the interruption copy mode, and transports the document sheet toward the first side of said document table when the image forming means is released from the interruption copy mode.

3. An image forming apparatus with an automatic document feeding apparatus according to claim 1, wherein said first and third transport means are located at the same side of said document table, and said control means controls said second and third transport means such that said first transport means transports the document sheet toward the first side of said document table when the image forming means is set in the interruption copy mode, and transports the document sheet toward the second side of said document table when the image forming means is released from the interruption copy mode.

4. An image forming apparatus with an automatic document feeding apparatus according to claim 1, wherein said image-reading means applies light to the document sheet while the document sheet remains at said predetermined position on the document table.

5. An image forming apparatus for performing an image forming operation to form, on an image bearing member, an image corresponding to an image on a document sheet, said apparatus comprising:

means for setting an interruption mode to interrupt the image forming operation, and for canceling the interruption mode to perform the image forming operation interrupted by setting said interruption mode;

a document table for supporting the document sheet; and means for automatically feeding the document sheet on said document table, said feeding means comprising:

(1) a cover member for covering said document table to automatically feed the document sheet on said document table and for opening said document table to manually support the document sheet on said document table when said setting/canceling means sets said interruption mode;

(2) first feeding means for feeding the document sheet on said document table to a predetermined portion when said setting/canceling means sets said interruption mode; and (3) second feeding means for feeding the document sheet from said predetermined portion to said document table when said setting/canceling means cancels said interruption mode and said cover member covers said document table after said cover member is opened to uncover said document table.

* * * * *